United States Patent [19]

Schomburg

[11] 4,268,031

[45] May 19, 1981

[54] PLAY AND EXERCISING DEVICE

[75] Inventor: Fay G. Schomburg, Bradenton, Fla.

[73] Assignee: Anthony Dama, Bradenton Beach, Fla. ; a part interest

[21] Appl. No.: 60,136

[22] Filed: Jul. 24, 1979

[51] Int. Cl.[3] ..... A63B 21/14

[52] U.S. Cl. ..... 272/128; 46/51; 272/142

[58] Field of Search ..... 272/93, 67, 128, 142, 272/68, 135, 137, 143, 139; 46/47, 51; 273/413, 414, 335

[56] References Cited

U.S. PATENT DOCUMENTS

| | | | |
|---|---|---|---|
| 178,352 | 6/1876 | Wheeler | 46/51 |
| 2,935,815 | 5/1960 | Wilhelm | 46/51 |
| 2,946,152 | 7/1960 | Rubin | 46/51 |
| 2,974,439 | 3/1961 | Fawick | 46/114 |
| 3,348,333 | 10/1967 | Cascioli | 46/51 |
| 3,425,690 | 2/1969 | Charbonnet | 272/139 |
| 3,509,660 | 5/1970 | Seymour | 46/51 |
| 3,532,340 | 10/1970 | Nardiello | 272/139 |
| 3,593,995 | 7/1971 | Eckstrom | 272/142 |
| 3,807,730 | 4/1974 | Dalton | 272/68 |

*Primary Examiner*—Richard J. Johnson
*Attorney, Agent, or Firm*—Hauke and Patalidis

[57] ABSTRACT

A play and exercising device comprising a hoop and a ball disposed substantially at the center of the hoop and connected to the hoop by at least four tensioned, radially disposed elastic strings or lines. In use, the ball is held in a hand and, through motion of the hand, the ball is oscillated back and forth thus causing the hoop to also oscillate back and forth relative to the ball, the amplitude of oscillation of the hoop being a function of the force applied to the ball and of the resiliency of the radial elastic strings or lines.

3 Claims, 4 Drawing Figures

FIG. 1
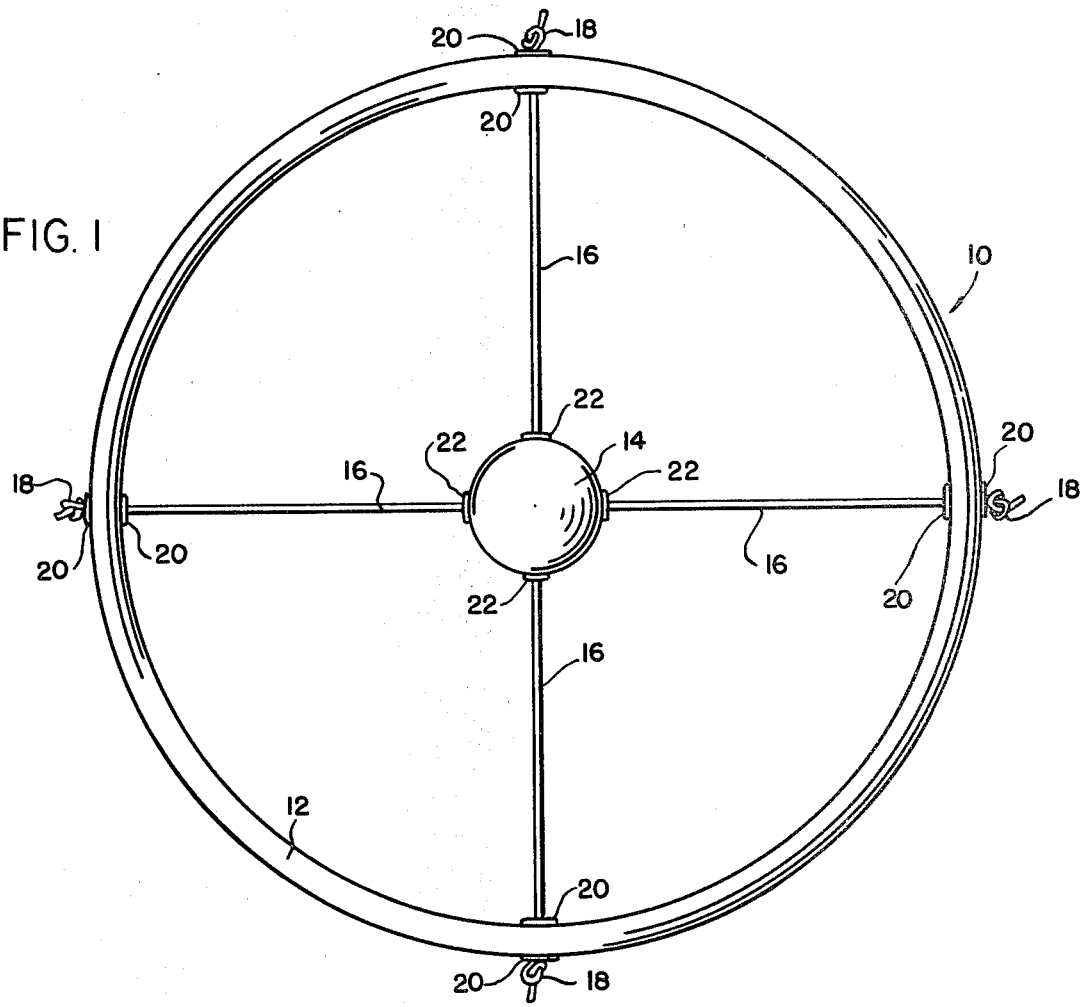
FIG. 2
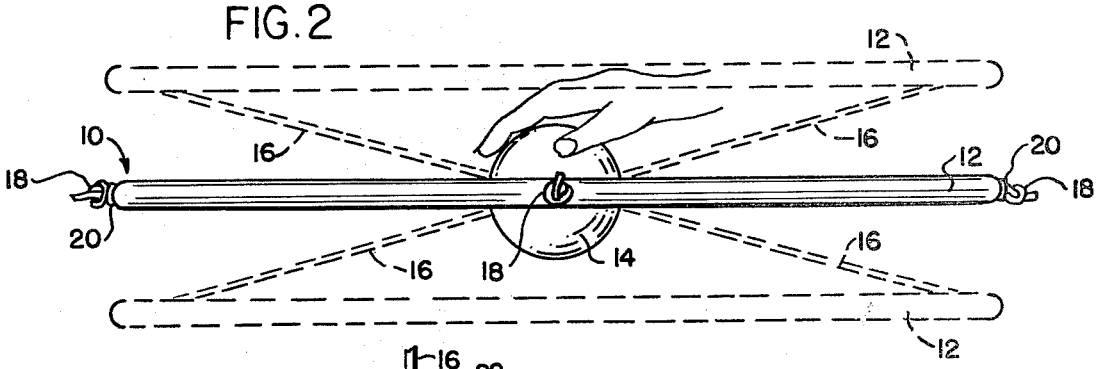
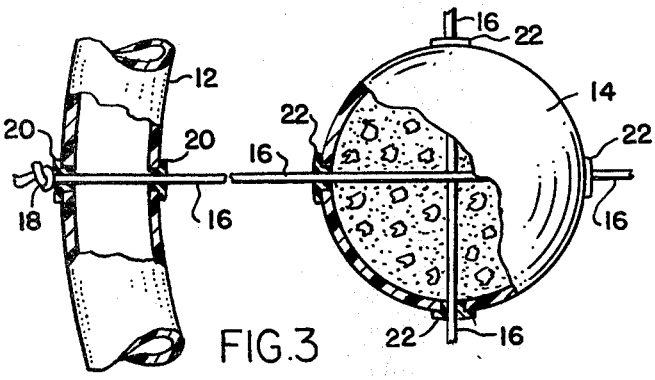
FIG. 3
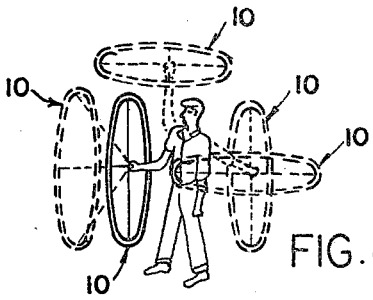
FIG. 4

PLAY AND EXERCISING DEVICE

BACKGROUND OF THE INVENTION

In the past diverse amusement devices have been made and marketed for the entertainment of primarily children, such as the well-known "Hula-Hoop" which, in addition to providing entertainment, is also often used as a prop for body exercises. Noise makers have been attached to hula-hoops, such as disclosed in U.S. Pat. Nos. 2,946,152 or 2,974,439. Balls have been attached to hula-hoops, such as disclosed in U.S. Pat Nos. 3,348,333 and 3,509,660. Hula hoops have also been spring-mounted from a belt attached to the waist of a person, as disclosed in U.S. Pat. No. 3,532,340.

SUMMARY

The present invention relates to a play and exercising device consisting essentially of a ball, such as a rubber ball or baseball, easily manually graspable, to which is attached a hoop, similar to a hula-hoop, disposed substantially concentrically to the ball and supported therefrom by means of four spoke-like tensioned elastic and flexible strings or lines.

The diverse objects and advantages of the present invention will become apparent to those skilled in the art when the following description of an example of the best mode contemplated for practicing the invention is read in conjunction with the accompanying drawing wherein:

BRIEF DESCRIPTION OF THE DRAWING

FIG. 1 is a plan elevational view of an example of play and exercising device according to the present invention;

FIG. 2 is a side elevational view of the device of FIG. 1 when in use;

FIG. 3 is a partial view of the device illustrated at FIG. 1 with portions broken away to show the internal construction; and FIG. 4 is a schematic view illustrating the device of the invention in use in several different positions.

DETAILED DESCRIPTION OF THE PREFERRED EMBODIMENT

Referring to the drawing, and more particularly to FIGS. 1–3 thereof, a play and exercising device 10 according to the present invention comprises an annular ring or hoop 12 preferably made of a tubular length of plastic material shaped in a closed circle with the abutting ends heat-welded or otherwise fastened together. The hoop 12 is supported from a spherical member such as a rubber ball 14 which may be hollow or, as illustrated, made of or filled with a mass of resilient rubber, foamed rubber or the like, by four strings or lines 16 of elastic material, such as rubber strands or sandows. The elastic strings 16 are disposed radially 90° from each other as the spokes of a wheel, the ends of each string passing through opposite walls of the hoop 12, and being fastened in position by means of a clip, retainer disk, or simply by means of a knot as shown at 18.

As illustrated in detail at FIG. 3, each elastic string 16 is passed proximate an end through the central aperture of a grommet 20, which may be made of plastic, rubber or metal, a pair of such grommets 20 being diametrically disposed through the wall of the tubular member forming the hoop 12, the peripherally projecting end of the elastic string 16 being retained by a knot 18. Each string 16 is also passed through diametrically opposed apertures in the ball 14, also provided with protective apertured grommets 22, and the other end of each string 16 is attached to the hoop 12, as illustrated at FIG. 1 and as shown in detail at FIG. 3, being passed through the apertures of the grommets 20 in opposite walls of the hoop 12 and, after being pulled such as to be stretched and tensioned diametrically, tied in position by means of the knot 18.

In operation, as shown at FIG. 2, the ball 14 is manually grasped, and by oscillating the hand back and forth, the hoop 12 is also caused to oscillate back and forth beyond its original plane, as illustrated in phantom line. According to the amount of force applied manually to oscillate the ball 14 back and forth, the amount of deflection of the hoop 12 from its original plane is increased proportionally. There results, in addition to providing a visual effect of a blurred apparent widening of the hoop 12 when viewed laterally, an effective exercising of the hand, including the fingers and the wrist, of the person using the device 10. By displacing the arm forwardly and extending the arm above the head, as schematically illustrated at FIG. 4, additional physical benefits result from actively exercising diverse arm and elbow muscles.

Althout clips or retainer rings may be used for holding the elastic strings 16, as shown at FIG. 3, through the ball 14 along octagonal diameters of the ball, it is preferable to leave the elastic strings 16 freely passing through the apertures of the ball grommets 22, as the tension pre-load applied on the elastic strings 16 and the octagonal diametrical passage of each string through the ball 14 causes the ball to be maintained substantially at the center of the annular hoop 12. The hand holding the ball 14 may also be oscillated in the plane of the hoop 12, preferably along one of the strings 16, thus causing the hoop 12 to oscillate radially while still remaining substantially in a single plane. It will be appreciated that horizontal motion and vertical motion of the hand may be combined such as to oscillate the hoop 12 relative to the ball 14 radially in a plane constantly oscillating in a direction perpendicular to that original plane or even at an angle to the original plane.

Having thus described the present invention by way of an example of structural embodiment thereof, modification whereof will be apparent to those skilled in the art, what is claimed as new is as follows:

1. A play and exercising device comprising an annular member, a manually graspable spherical member disposed substantially at the center of said annular member, and at least two pairs of elastic stretched strings radially connecting said annular member to said spherical member, wherein each pair of said strings is a single length of elastic line passed freely through diametrical apertures in said spherical member, the ends of said line being attached to said annular member at diametrically opposed points.

2. The device of claim 1 wherein said spherical member is a rubber ball.

3. The device of claim 1 wherein said annular member is a tubular hoop.

* * * * *